US007926798B2

(12) United States Patent
Taketsugu et al.

(10) Patent No.: US 7,926,798 B2
(45) Date of Patent: Apr. 19, 2011

(54) SADDLE-STITCHED BROCHURE REMOVABLY HOLDING SMALL PRINTED MATERIAL AND APPARATUS FOR MAKING THE SAME

(75) Inventors: Yasuo Taketsugu, Shiga (JP); Hisahiro Hirayama, Shiga (JP)

(73) Assignee: Horizon International Inc., Shiga (JP)

( * ) Notice: Subject to any disclaimer, the term of this patent is extended or adjusted under 35 U.S.C. 154(b) by 413 days.

(21) Appl. No.: 11/800,818

(22) Filed: May 8, 2007

(65) Prior Publication Data

US 2007/0262509 A1 Nov. 15, 2007

(30) Foreign Application Priority Data

May 10, 2006 (JP) ..... 2006-131241

(51) Int. Cl.
*B65H 37/04* (2006.01)

(52) U.S. Cl. ..... 270/37; 270/32; 270/45; 270/51; 270/52.18; 270/58.07; 270/58.08; 270/58.11; 281/9; 281/12

(58) Field of Classification Search ..... 270/32, 270/37, 45, 51, 52.14, 52.18, 52.19, 58.07, 270/58.08, 58.11; 281/3.1, 5, 7, 9, 12, 14, 27.3

See application file for complete search history.

(56) References Cited

U.S. PATENT DOCUMENTS

| | | | | |
|---|---|---|---|---|
| 5,590,912 | A * | 1/1997 | Stevens | 283/56 |
| 5,738,346 | A * | 4/1998 | Ishida | 270/58.07 |
| 6,095,510 | A * | 8/2000 | Jaeger | 270/52.18 |
| 6,688,648 | B2 * | 2/2004 | McKinney et al. | 281/12 |
| 6,793,210 | B2 * | 9/2004 | Sato | 270/37 |
| 7,261,507 | B2 * | 8/2007 | Horii et al. | 412/35 |
| 2003/0214092 | A1 * | 11/2003 | Horii et al. | 270/52.18 |

* cited by examiner

*Primary Examiner* — Leslie A Nicholson, III
(74) *Attorney, Agent, or Firm* — Kirschstein, et al.

(57) ABSTRACT

A saddle-stitched brochure comprising a collated sheet stack (P1 to P3) folded in two at its center portion and stitched with wire at least two positions spaced from each other on the folding line (1*a*), characterized in that a small printed material (2, 2*a*) is arranged between the adjacent sheets (P2, P3) of the sheet stack (P1 to P3) and inserted between the adjacent stitched portions (3, 3) on the folding line (1*a*) and folded along the folding line (1*a*) together with the sheet stack (P1 to P3) so as to be held in the brochures (1).

1 Claim, 3 Drawing Sheets

SADDLE-STITCHED BROCHURE REMOVABLY HOLDING SMALL PRINTED MATERIAL AND APPARATUS FOR MAKING THE SAME

BACKGROUND OF THE INVENTION

1. Technical Field

The present invention relates to a saddle-stitched brochure removably holding a small printed material comprising a postcard or an envelope for reply and an apparatus for making such saddle-stitched brochure.

2. Background Art

A saddle-stitched brochure comprises a stack of collated sheet folded in two at its center portion and stitched with wire at least two positions spaced from each other on the folding line. In the prior art, a saddle-stitched brochure removably holding a small printed material comprising a postcard or an envelope for reply has been known. In this case, the printed material is held by joining an edge of the postcard or the envelope to a given page of the brochure with an adhesive, or by wire stitching a leaf to which the postcard or the envelope is detachably incorporated through perforation with a stack of sheets constituting the brochure on bookbinding.

However, according to the method of joining the small printed material with an adhesive, the adhesive may attach to the pages of the brochure and contaminate the brochure at adhesion process, and the method of wire stitching the leaf including the small printed material with the sheet stack has a problem that the remaining portion makes the appearance of the brochure bad after the small printed material was cut away along perforation.

SUMMARY OF THE INVENTION

Therefore, it is an object of the present invention to provide a saddle-stitched brochure removably holding a small printed material in a good appearance.

According to the present invention, this object is achieved by providing a saddle-stitched brochure comprising a collated sheet stack folded in two at its center portion and stitched with wire at least two positions spaced from each other on the folding line, characterized in that a small printed material is arranged between the adjacent sheets of the sheet stack and inserted between the adjacent stitched portions on the folding line and folded along the folding line together with the sheet stack so as to be held in the brochures.

According to a preferred embodiment of the present invention, the small printed material comprises a postcard with an extension portion extending in its longitudinal or width direction, and the extension portion of the postcard are inserted between the adjacent stitched portions and folded along the folding line.

Alternatively, according to the present invention, the above-mentioned object is achieved by providing a device for making a saddle-stitched brochure, characterized by a sheet collating machine comprising at least three sheet feeding units arranged in a vertical direction, a sheet conveying path arranged oppositely to outlets of the sheet feeding units and extending in a vertical direction, and a conveying means for conveying sheets discharged one by one from the sheet feeding units downwardly along the sheet conveying path and overlapping the sheets in the order corresponding to the arrangement of the sheet feeding units so as to form a sheet stack; and a saddle-stitching machine for folding the sheet stack discharged from the sheet collating machine in two at center portion thereof along a direction perpendicular to the sheet conveying direction and stitching the sheet stack with wire at least two positions spaced from each other on the folding line, a stack of said small printed materials being loaded into an arbitrary sheet feeding unit excluding the uppermost and lowermost sheet feeding units, a stack of each of sheets constituting a brochure being loaded into the other sheet feeding units, the small printed material being discharged from the related sheet feeding unit at a later timing than a timing of discharge of the sheets constituting the brochure and inserted between the adjacent sheets of the sheet stack in such a manner that the small printed material is located cross the folding line of the sheet stack and between the adjacent stitched portions on the folding line.

DETAILED DESCRIPTION OF THE PREFERRED EMBODIMENTS

Figure 1A:
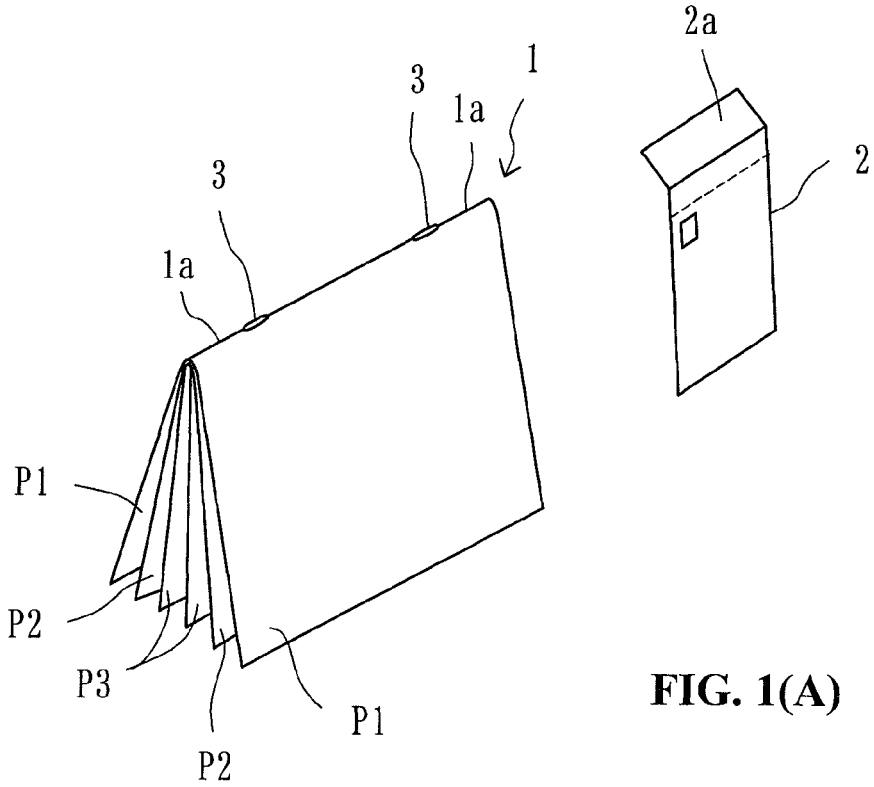
FIG. 1(A) is a perspective view illustrating a saddle-stitched brochure according to an embodiment of the present invention in which the saddle-stitched brochure is disassembled into a main body thereof and a printed material.
Figure 1B:
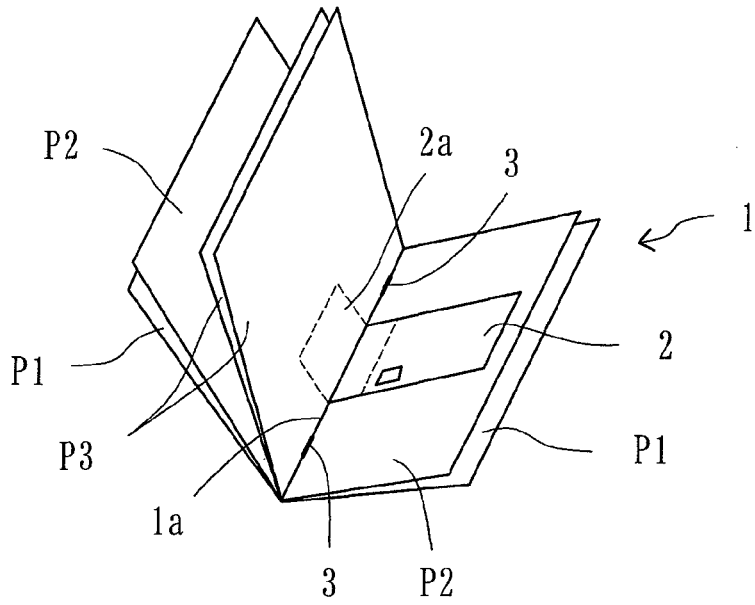
FIG. 1(B) is a perspective view illustrating a saddle-stitched brochure according to an embodiment of the present invention in which the saddle-stitched brochure is opened at the pages removably holding a printed material.

Preferred embodiments of the present invention will be explained below with reference to the accompanying drawings. FIG. 1(A) is a perspective view illustrating a saddle-stitched brochure according to an embodiment of the present invention in which the saddle-stitched brochure is disassembled into a main body thereof and a printed material. FIG. 1(B) is a perspective view illustrating a saddle-stitched brochure according to an embodiment of the present invention in which the saddle-stitched brochure is opened at the pages removably holding a printed material.

As shown in FIG. 1(A), the saddle-stitched brochure of the present invention comprises the main body of the brochure 1 and a printed material removably held in the main body of the brochure 1. In this embodiment, the printed material is a postcard 2 with an extension portion 2*a* extending in a longitudinal direction thereof. The main body of the brochure 1 comprises a stack of the collated sheets P1-P3 folded in two at its center portion and bound with one another through wire 3 at least two positions spaced from each other on the folding line 1*a*.

As shown in FIG. 1(B), according to the present invention, the postcard 2 is arranged between the adjacent sheets P2 and P3 in the sheet stack P1-P3, and the extension portion 2*a* of the postcard 2 is inserted between the adjacent stitched portions 3, 3 on the folding line 1*a* and folded together with the sheet stack P1-P3 along the folding line 1*a* so as to be held in the brochure 1.

According to the present invention, the small printed material 2, 2*a* is inserted between the adjacent stitched portions 3, 3 and folded into two together with the sheet stack P1-P3 so as to be securely held in the brochure 1 without being stitched to the sheet stack P1-P3 with wire and without an adhesive. Thus the small printed material 2, 2*a* can be removed from the brochure 1 easily by taking out the printed material 2, 2*a* from the brochure 1. In addition, the appearance of the brochure 1 does not become bad after the small printed material 2, 2*a* was removed from the brochure 1.

Figure 2A:
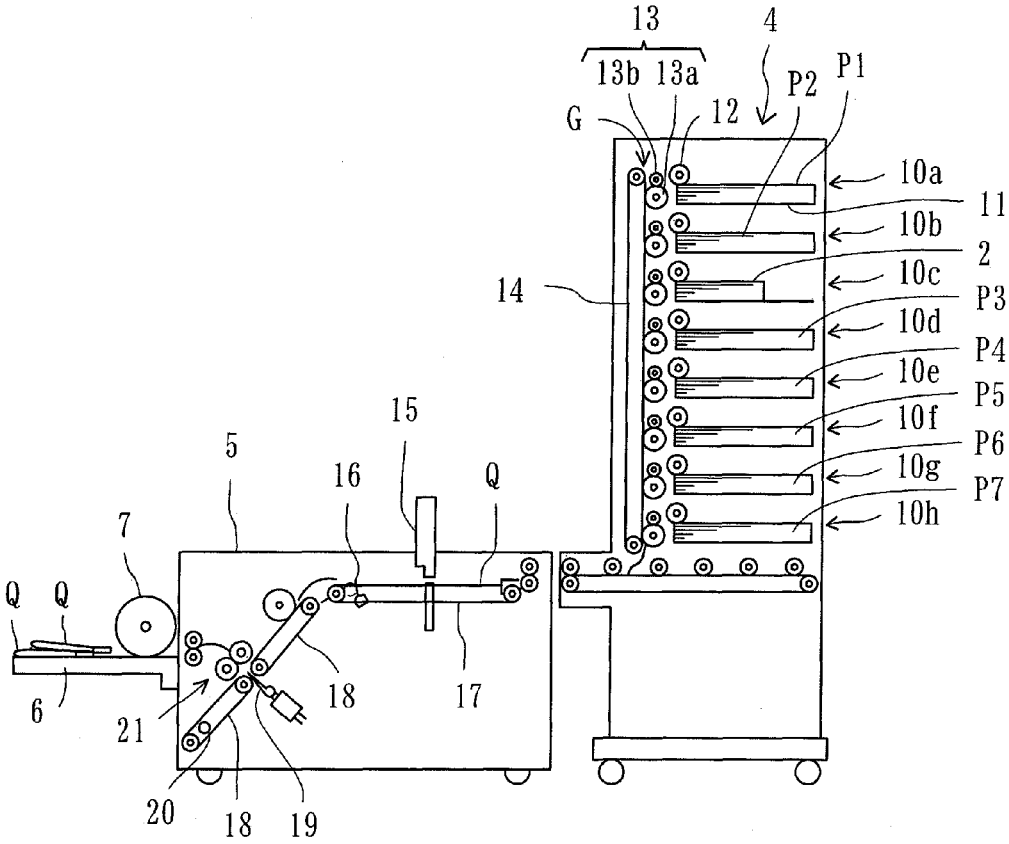
FIG. 2(A) is a schematic diagram illustrating the internal structure of an apparatus for making the saddle-stitched brochures according to an embodiment of the present invention.

FIG. 2(A) is a schematic diagram illustrating the internal structure of an apparatus for making the saddle-stitched brochures according to an embodiment of the present invention. In FIG. 2(A), the numeral 4+designates a vertical sheet collating machine, the numeral 5 designates a saddle-stitching machine, the numeral 6 designates a table receiving finished saddle-stitched brochures and the numeral 7 designates a press roller.

The vertical sheet collating machine 4 comprises a plurality of sheet feeding units 10*a*-10*h* arranged at regular spacing therebetween and a sheet conveying path G arranged oppositely to the outlets of the sheet feeding units 10*a*-10*h*.

The sheet feeding units 10*a* to 10*h* respectively comprise a table 11 on which a sheet stack is loaded, a feeding roller 12 arranged above the table 11 for successively discharging the uppermost sheet of the sheet stack horizontally, and a sheet feeding means 13 arranged between the feeding roller 12 and sheet conveying path G for directing the sheet horizontally discharged from the feeding roller 12 perpendicularly downward to the sheet conveying path G. The sheet feeding means 13 comprises a pair of a driving roller 13*a* and an idle roller 13*b* which are arranged for rotation round horizontal axes and contacted with each other.

The vertical sheet collating machine 4 further comprises a conveying means 14 for conveying sheets discharged one by one from the sheet feeding units 10*a*-10*h*downwardly along the sheet conveying path G and overlapping the sheets in the order corresponding to the arrangement of the sheet feeding units 10*a*-10*h* so as to form a sheet stack Q. The conveying means 14 consists of a belt conveyer. In addition, the driving roller 13*a* of each sheet feeding unit 10*a*-10*h* touches the conveying surface of the belt conveyer 14 and functions as a conveying roller to convey the sheets in conjunction with the belt conveyer 14.

Then, on the table 11 of the third sheet feeding unit 10*c*, a stack of the small printed materials, in this embodiment, a stack of the postcards 2 with an extension portions 2*a* is placed, and on the tables of the other sheet feeding units 10*a*-10*b* and 10*d*-10*h*, a stack of each of the sheets P1-P7 constituting the main body of the brochure is loaded.

At collating operation of the sheet collating machine, a sheet P1 is fed from the uppermost sheet feeding unit 10*a* to the sheet conveying path G, and the sheet P1 is conveyed downwards by the conveyer belt 14 and the driving roller 13*a*. When the sheet P1 reaches the outlet of the sheet feeding unit 10*b*, the second sheet feeding unit 10*b* feeds a sheet P2 so that the leading edge of the sheet P2 meets the leading edge of the sheet P1. Thereby the sheet P2 is lapped on the conveyed sheet P1. Then, the same operation is repeated, a sheet P7 fed from the lowermost sheet feeding unit 10*h* is lapped and consequently a stack of collated sheet is formed.

Figure 2B:
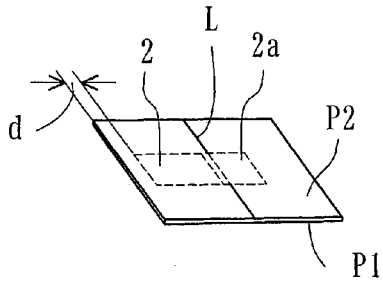
FIG. 2(B) is a schematic diagram illustrating a collating process of sheets constituting a brochure and a small printed material.

In this collating operation, the postcard 2 with an extension portion 2*a* loaded on the table 11 of the third sheet feeding unit 10*c* is discharged at a later timing than the timing of discharge of the other sheets P1-P7, and fed on a stack of the sheet P1 and the sheet P2. Then, as shown in FIG. 2(B), the postcard 2 with an extension portion 2*a* is lapped in such a manner that its edge shifts the distance (d) backwards from the edge of the stack of the sheets P1 and P2 and the extension portion 2*a* is located crosses a center line L in a longitudinal direction of the stack (a folding line of the sheet stack is formed later). The shift of the edge of the postcard 2 prevents a part of the postcard 2 from being cut off in the later sheet stack trimming process. The distance (d) of the shift can be changed by changing the delay time of the timing of sheet discharge.

The saddle-stitching machine 5 receives the sheet stack Q discharged from the vertical sheet collating machine 4 and folds the sheet stack Q in two at its center portion along the perpendicular direction to the sheet conveying direction (the longitudinal direction of the sheet stack Q) in the vertical sheet collating machine 4, and stitches with wire at two positions spaced from each other on the folding line.

The saddle-stitching machine 5 comprises a conveyer belt 17 for conveying the collated sheet stack Q to the stitch position, a stitch head 15 arranged at the stitch position for up-and-down movement so as to stitch the sheet stack Q with wire at two positions on the center line L in a longitudinal direction of the sheet stack Q (a folding line of the sheet stack is formed later), a stopper 16 for stopping and positioning the sheet stack Q conveyed on the conveyer belt 17 at the given position, a conveyer belt 18 for conveying the saddle-stitched sheet stack Q to the folding position, a folding knife 19 arranged at the folding position for forth-and-back movement so as to fold the sheet stack Q along the center line L, a stopper 20 for stopping and positioning the sheet stack Q conveyed on the conveyer belt 18 at the given position and a pair of nip rollers 21 forming a solid folding line in the sheet stack Q pushed forward by the folding knife 19.

Then, the postcard 2 with the extension portion 2*a* is inserted and the collated sheet stack Q is stitched with wire at two positions spaced from each other on the centerline L at the stitching position of the saddle-stitching machine 5. At this time the postcard 2 with the extension portion 2*a* has been inserted into the sheet stack Q by the vertical sheet collating machine 4 in such a manner that the extension portion 2*a* is located between the adjacent stitched portions.

Thereafter the sheet stack Q is folded along the center line L at the folding position and a folding line is formed on the center line L by being nipped between a pair of nip rollers 21.

Furthermore, after the sheet stack Q is pressed by a press roller 7 so as to make the folding line stronger, the sheet stack Q is discharged on the table 6. The discharged sheet stack Q is conveyed to the sheet cutting process so as to be trimmed at three sides thereof and the saddle-stitched brochure is completed.

Figure 3:
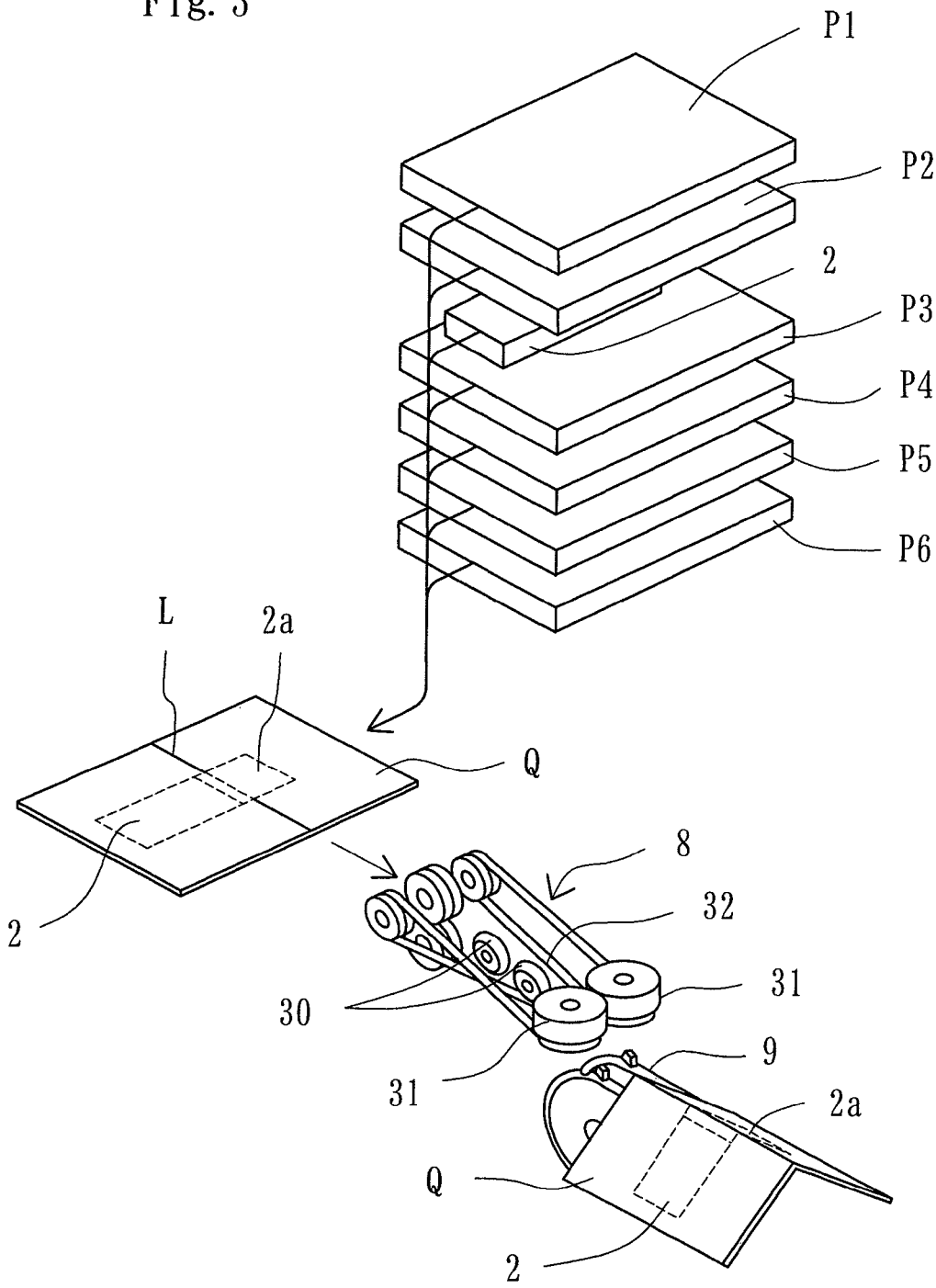
FIG. 3 is a schematic diagram illustrating the internal structure of an apparatus for making a saddle-stitched brochure according to another embodiment of the present invention.

In addition, according to the embodiment of FIG. 2(A), the folding operation follows the wire stitching operation, but it is possible that the wire stitching operation follows the folding operation, as shown in FIG. 3.

With reference to FIG. 3, in this embodiment, the saddle-stitching machine comprises a folding section 8 and a stitching section 9. Then, the postcard 2 with the extension portion 2*a* is inserted, the collated sheet stack Q is conveyed to the folding section 8, and the sheet stack Q is pushed up along the center line L by a folding roller 30 and pushed down at both sides thereof by a belt 32 while conveyed past the folding section 8, and nipped by a pair of press rollers 31 and 31 so as to be folded along the center line L. The sheet stack Q provided with the folding line is conveyed to the stitching section 9 and stitched with one another through wire at two positions 3 spaced from each other on the folding line L.

The constitution of the present invention is not limited to the above-mentioned embodiment. For example, in the above-mentioned embodiment, the post card 2 is provided with the extension portion 2*a* extending in its longitudinal direction, but the post card 2 may be provided with an extension portion extending in its width direction. In addition, as a printed material, for example, an envelope or base sheet for putting in CDs can be used.

What is claimed is:

1. A method of making a saddle-stitched brochure (1), comprising the steps of:

arranging a plurality of sheet feeding units (10*a* to 10*h*) of a sheet collating machine (4) in an order along a vertical direction;

loading a printed material stack of small printed materials (2, 2*a*) into a selected sheet feeding unit (10*c*) arranged between an uppermost sheet feeding unit (10*a*) and a lowermost sheet feeding unit (10*h*);

loading sheet stacks of sheets (P1 to P7) in the sheet feeding units other than the selected sheet feeding unit (10*c*);

discharging and conveying the sheets (P1 to P7) and the small printed materials (2, 2*a*), one by one, from the sheet feeding units (10*a* to 10*h*) in descending order to a saddle-stitching machine (5) along a sheet conveying path (G) such that leading edges of the sheets (P1 to P7) are aligned with one another and a leading edge of the small printed material (2, 2*a*) is offset from the aligned leading edges of the sheets (P1 to P7), while the sheets (P1 to P7) and the small printed material (2, 2*a*) are overlapped with one another in an order corresponding to the order of the arranged sheet feeding units (10*a* to 10*h*) so as to form a collated stack (Q) upon arrival at the saddle-stitching machine (5);

folding the collated stack (Q) in half in the saddle-stitching machine (5) at a center portion of the collated stack (Q) along a folding line (L), and also simultaneously folding the small printed material (2, 2*a*) within the collated stack (Q) along the folding line (L); and stitching the sheets (P1 to P7) of the collated stack(Q) together in the saddle-stitching machine (5) on the folding line (L) with wire at adjacent stitched wire portions (3, 3) spaced apart and away from opposite sides of the small printed material (2, 2*a*) that is removably held in the saddle-stitched brochure (1).

* * * * *